United States Patent [19]

Shakas

[11] 4,146,938

[45] Apr. 3, 1979

[54] COMBINATION BATHTUB AND BASSINET STRUCTURE

[76] Inventor: Pauline V. Shakas, 1620 Lasuen Rd., Santa Barbara, Calif. 93103

[21] Appl. No.: 765,815

[22] Filed: Feb. 4, 1977

[51] Int. Cl.[2] ..... A47K 3/064

[52] U.S. Cl. ..... 4/177 R; 4/185 B; 5/366

[58] Field of Search ..... 4/177 A, 185 B; 5/105, 5/108, 109, 366, 365, 99 A, 345 R

[56] References Cited

U.S. PATENT DOCUMENTS

| | | | |
|---|---|---|---|
| 2,760,208 | 8/1956 | Mussells | 4/185 B |
| 3,015,111 | 1/1962 | Parker | 4/177 A |
| 3,235,891 | 2/1966 | Chade et al. | 5/109 |
| 3,419,923 | 1/1969 | Cowan | 5/109 |
| 3,608,961 | 9/1971 | Von Heck | 5/345 R |
| 3,739,409 | 6/1973 | Johnson | 5/345 R |
| 3,849,814 | 11/1974 | Ross | 5/366 |
| 3,965,508 | 6/1976 | Hunter | 5/368 |
| 4,066,072 | 1/1978 | Cummings | 5/366 |

*Primary Examiner*—William D. Martin, Jr.
*Attorney, Agent, or Firm*—Spensley, Horn & Lubitz

[57] ABSTRACT

A combined bathtub and bassinet structure is disclosed that includes a collapsible X-frame which when opened will receive and support either a bathtub or a bassinet. Both the bathtub and bassinet generally are of rectangular form, made of flexible material, and when supported on the frame have opposed ends and sidewalls to which is attached a bottom wall. At least the bassinet includes an upper and a lower bottom wall in a vertically spaced relationship, and an opening in one of the upright walls to permit a reinforcing panel to be inserted between the upper and lower bottom walls. The bassinet includes a water bed type mattress preferably with a heating element to maintain it at a body temperature. The bassinet also may include sound-producing means to mimic heart sounds.

7 Claims, 3 Drawing Figures

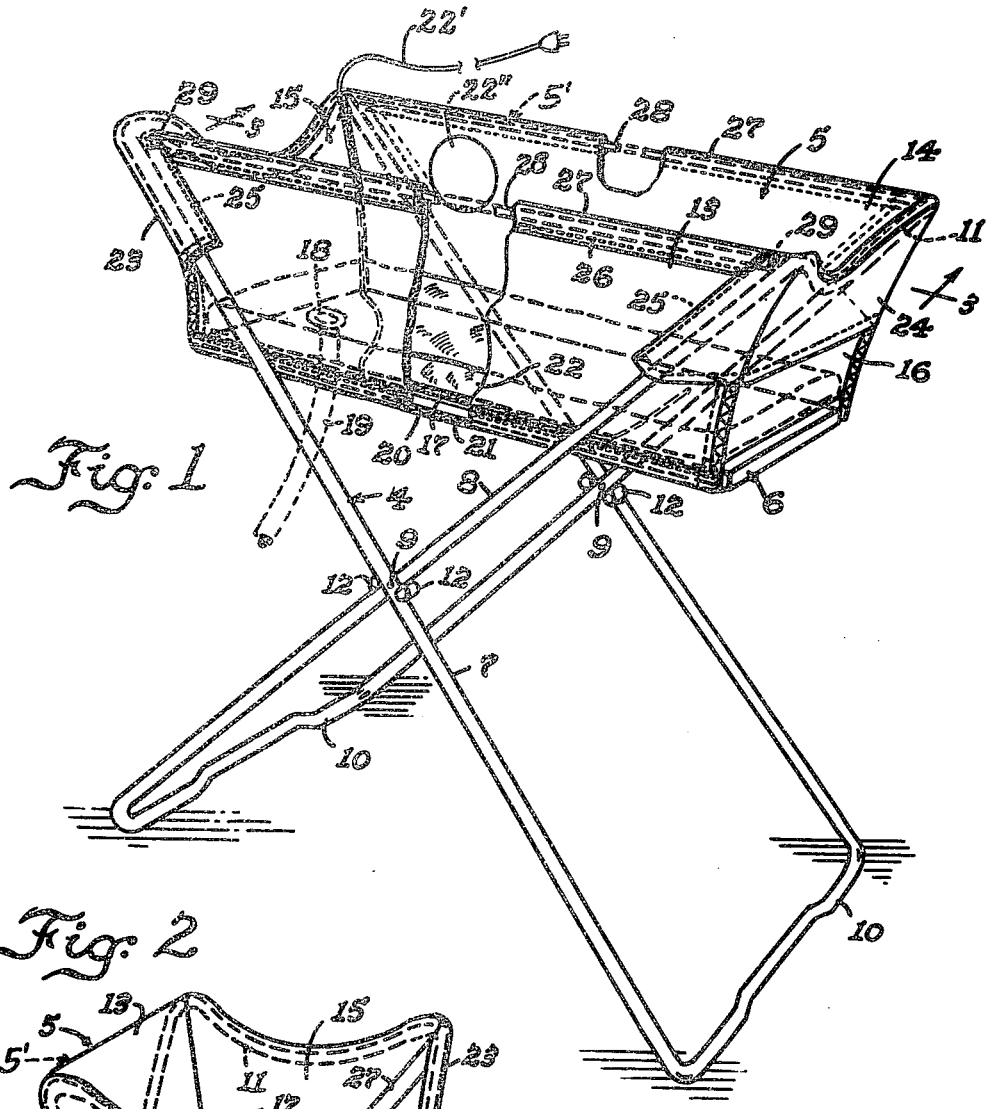
Fig. 1
Fig. 2
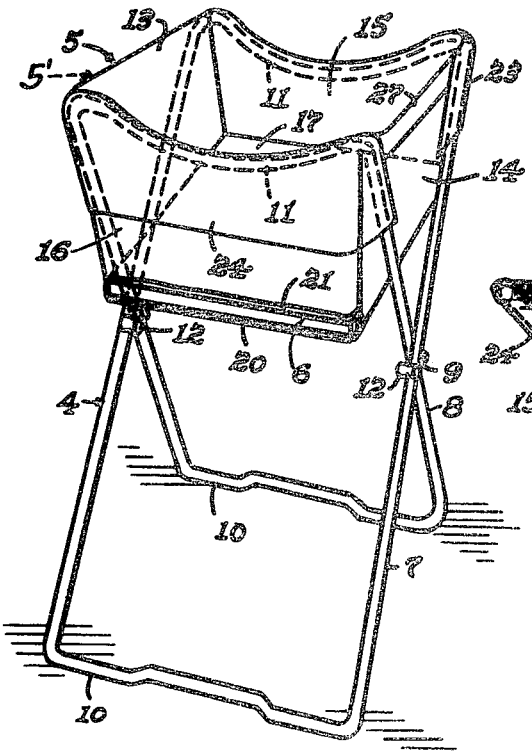
Fig. 3
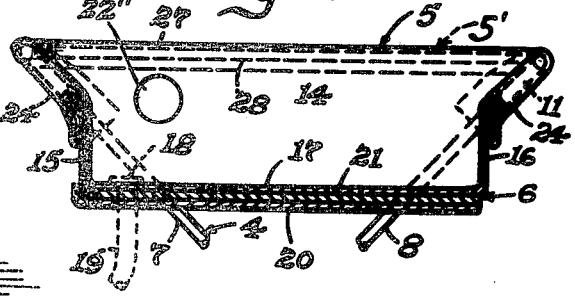

COMBINATION BATHTUB AND BASSINET STRUCTURE

BACKGROUND OF THE INVENTION

Many different bathtub and bassinet structures have been designed for babys. Generally they approximate similar structures designed for more mature individuals, the bathtub being simply a waterproof container, the bassinet being simply a flat bed.

In recent years it has become clear, from the teachings of Dr. Frederick Leboyer and others, that it is by far preferable to permit babys to gradually adapt themselves to the physical world after birth. The baby should be permitted to unfold itself and slowly open to the world at its own pace. They teach that it is particularly important to cradle the baby's spine, and to permit the baby to stretch and straighten itself as and when it so desires. Unfortunately, few if any bathtub and bassinet structures permit such a gradual unfoldment by the baby. Being designed as miniature versions of similar structures for adults, they implicitly assume that the child is a miniature adult, ignoring these important recent teachings of Dr. Leboyer and others.

An object of the present invention is to provide a combined bathtub and bassinet structure that is specifically designed and adapted to permit a baby held by such structure readily to assume the position most natural to it at that time. The structure should permit the baby's relatively unfettered movement to stimulate its exercise and exploration of the physical world. The bassinet should provide gentle, uniform support to the child in a wide range of positions, permitting the child to slowly adapt itself to the force of gravity. It should provide warmth, softness, freedom, and encourage a feeling of weightlessness. As the baby grows, gradually stretching and straightening its spine, the bassinet preferably should change and adapt to such changes in the baby. These and other objects of the invention will be apparent from the following description of a preferred embodiment.

BRIEF DESCRIPTION OF THE INVENTION

A combined bathtub and bassinet structure is disclosed that includes a collapsible X-frame which when opened will receive and support either a bathtub or a bassinet. Both the bathtub and bassinet generally are of rectangular form, made of flexible material, and when supported on the frame have opposed ends and sidewalls to which is attached a bottom wall. At least the bassinet includes an upper and a lower bottom wall in a vertically spaced relationship, and an opening in one of the upright walls to permit a reinforcing panel to be inserted between the upper and lower bottom walls. The bassinet includes a water bed type mattress preferably with a heating element to maintain it at a body temperature. The bassinet also may include sound-producing means to mimic heart sounds.

BRIEF DESCRIPTION OF THE DRAWINGS

The invention is illustrated in the accompanying drawing, in which -

FIG. 1 is a perspective of the improved combination bathtub and bassinet, portions thereof being broken away to better illustrate the construction;

FIG. 2 is another perspective view taken at another angle, and

FIG. 3 is a longitudinal section of the line 3—3 of Fig. 1.

DETAILED DESCRIPTION

The combination bathtub and bassinet of the invention consists of a foldable X-frame 4 which serves as a supporting base, a generally rectangular bag or container 5 for bassinet use and adapted to be supported interchangeably on the top of the X-frame 4, and a generally similar rectangular bag of container 5' for bathtub use. The bassinet includes a reinforcing bottom defining panel 6 insertable in the bottom of bag 5. The X-frame 4 preferably is made of metallic tubing or of rod material in the form of two rectangular frame members 7 and 8, frame member 8 fitting inside frame member 7 and pivotally connected therewith by pins 9 at the points of intersection. These points are at approximately the mid-points between the lower ends 10 of the frame members that engage the floor and the upper end portions 11 that support the bag 5. Stop projections 12 are welded or otherwise suitably secured onto the side portions of frame member 7 in transverse relation to the side portions of frame member 8 so as to limit the unfolding of the X-frame 4 when the frame members 7 and 8 are approximately in right angle relationship to one another, as shown in FIG. 1. The stops 12 are disposed far enough apart on frame member 7 to permit frame member 8 to be folded approximately into the plane of frame member 7.

The container 5 which is for bassinet use, has the body thereof made of one piece of any suitable flexible sheet material, such as canvas, folded to a generally rectangular form providing side walls 13 and 14, end walls 15 and 16, and a bottom wall 17 all joined together at the corners. The container 5', for bathtub use, is substantially the same as container 5 but made of a flexible plastic sheet material. It has a drain opening 18 provided in one end of the bottom 17. A flexible tube 19 extends therefrom, which tube is adapted to be closed by being pinched by the usual form of hose-fitting that may be readily opened or closed on the tube. In the bassinet 5, a sub-bottom 20 of the same or similar material to the rest of the container is fastened to the bottom 17, thereby defining a pocket 21. An opening into pocket 21 is provided in one of the side walls, allowing the bottom panel 6 to be inserted with an easy sliding fit. This hardboard panel holds the bottom of the container 5 neatly in the rectangular form shown in FIG. 1 and keeps the bottom 17 flat and firm so that it will form a good support for a mattress 22 indicated in FIG. 1. Container 5' may or may not be provided with a pocket 21 for panel 6.

Preferably mattress 22 is a waterbed type of mattress, being formed as a plastic membrane or bladder receiving a volume of water. Of course, the bassinet could be used without a mattress, or with a conventional type of mattress. However, a waterbed type of mattress is preferred since such a structure will provide a uniform support over much of the baby's body, cradling the baby, yet permitting the baby to move about in a relatively free fashion to exercise and to explore its environment. In the first few days following the baby's birth, the bassinet should be used with the mattress but without any reinforcing panel 6 to enhance the fetal, cradling, support it provides. Often the baby will be placed in the bassinet in a fetal position, being supported on its side, and will continue to assume this fetal position in the bassinet. As the baby grows, it will gradually stretch and straighten its spine and turn from the fetal, side position to a straighter, flat position. Thus, initially the mattress will be only partially filled, and used without reinforcing panel 6, to provide a very soft support for the infant, a support approximating the child's prenatal environment and cradling the baby's spine in a fetal position. Gradually, additional water is added to the mattress to increase its firmness as the child grows and turns to prefer a rest position laying flat on its back. At that time, additional water may be added to the mattress to increase somewhat its firmness. Also panel 6 may be added to the bassinet, being received within pocket 21 to further flatten the mattress and to, while lessening somewhat the area of contact between the baby and the mattress, permit the baby greater freedom of movement. The waterbed mattress preferably includes a heating element 22' that is adjustable to maintain the temperature of the water within the mattress at approximately body temperature. This, too, assists significantly in easing the baby's transition from the womb to the physical world. To further enhance and ease this transition, a sound producing device 22'' may be attached to or incorporated in the bassinet, this sound producing device generating sounds simulating the mother's heartbeat. While this device may be an electrically powered device, preferably it is a spring powered device that is wound upon placing the baby in the bassinet and permitted to gradually run down until it no longer produces a heartbeat sound, thereby gradually acclimating the baby to the absence of such sound in the world about him.

Pockets 23 and 24 that are open at the bottom and closed at the top are provided at both ends of the containers 5 and 5'. In the case of container 5 these pockets are formed by outward and downward extensions of the end walls 15 and 16 which are sewed or otherwise suitably secured to the sides 13 and 14 forwardly of the ends thereof, as indicated at 25. This sewing along the sides is on lines substantially parallel to the upper end portions of the frame members 7 and 8 so that these may be slipped into the pockets 23 and 24 to support the container 5 on the X-frame 4. The upper ends of the sides 13 and 14 on both containers 5 and 5' are folded outwardly and downwardly and sewed, as indicated at 26, to provide reinforcing tunnels 27 extending lengthwise of the containers on both sides. In these tunnels are flexible reinforcing tapes 28, the ends of which are anchored to the ends of the sides 13 and 14 partly by the stitching 25 and partly by additional stitching, as indicated at 29. These tapes and tunnels together absorb a good share of the strain imposed on the container 5' when it is filled to the normal level with water and is being used as a tub in bathing an infant, the load imposed under those conditions being, of course, much greater than when container 5 is being used as a crib.

The operation of the combination bathtub and bassinet is believed to be clear from the foregoing description. The one article with interchangeable container 5 and 5' serves a double purpose and its initial cost will not exceed the cost of either of the two conventional articles which it replaces. Of course, it is obvious that, being a double purpose article, it saves space in the home. Furthermore, when it is not in use it can be folded up to a compact size for easy storage. That is also of advantage when it is desired to transport the article from one location to another by train or automobile. The taking down and setting up of the unit requires very little time and no ingenuity. Also, there is nothing in the unit that is apt to get out of order.

It is believed the foregoing description conveys a good understanding of the objects and advantages of the invention. Since variations of the structure will be apparent to those skilled in this art from the foregoing teaching, the scope of the invention is set forth in the following claims.

I Claim:

1. A bassinet including a supporting frame structure, a generally rectangular open top container somewhat larger than an infant, the container being formed of interconnected, flexible side walls, end walls, and a bottom wall, means for attaching the container to the frame, a waterbed mattress consisting of a bladder that may be partially or completely filled with water, the amount of water included in the bladder determining its firmness, the bladder including a sealable opening permitting the amount of liquid contained in the mattress to be varied, the mattress being snugly received in the bottom of the container, the container further including a removable, rigid panel underlying substantially all of the waterbed mattress, whereby the firmness of the mattress support provided by the bassinet can be adjusted from a very soft condition approximating a prenatal environment and suitable for cradling a baby's spine in a fetal position to a firm condition suitable for properly supporting the spine of an infant resting flat on its back, permitting an infant to assume the position most natural to it at that stage of its development.

2. A bassinet as set forth in claim 1 in which the container includes two spaced bottom panels defining between them a pocket for receiving the panel, at least one of the side walls including an opening through which the panel may pass.

3. A bassinet as set forth in claim 1, the bassinet further including a physically simulating an infant's prenatal environment.

4. A bassinet as set forth in claim 3 in which the device is a sound producing device and includes means which limit its period of sound production.

5. A bassinet as set forth in claim 2 in which the supporting frame structure is formed by two generally rectangular frame members which are secured together in criss-cross relation so that their lower ends are adapted to rest on the floor and their upper end portions are disposed in upwardly diverging relation, and in which the container is of generally rectangular form and is adapted to receive an infant, the container having downwardly opening pockets provided on the outer sides of the opposite ends thereof into which the upper end portions of said frame members are received so as to support said container securely on said base but allow quick and easy removal.

6. A bassinet as set forth in claim 5 in which the container is made of flexible sheet material foldable to compact size when the container is removed from said frame, the pocket formed in the bottom thereof extending substantially the full width and full length of the container, and open on one side, the panel being a generally rectangular bottom defining panel of relatively stiff material and inserted in said pocket.

7. A bassinet as set forth in claim 6, the bassinet including a sound producing device for producing sounds simulating the heartbeat of the infant's mother, the sound producing device including means to limit its period of sound production, the bassinet further including a heater to maintain the temperature of the liquid in the mattress at approximately the body temperature of an infant.

* * * * *